US012129147B2

(12) United States Patent
Altergott

(10) Patent No.: US 12,129,147 B2
(45) Date of Patent: Oct. 29, 2024

(54) ROTATING REEL SYSTEM

(71) Applicant: Adam Altergott, Spearfish, SD (US)

(72) Inventor: Adam Altergott, Spearfish, SD (US)

( * ) Notice: Subject to any disclaimer, the term of this patent is extended or adjusted under 35 U.S.C. 154(b) by 0 days.

(21) Appl. No.: 17/456,233

(22) Filed: Nov. 23, 2021

(65) Prior Publication Data

US 2023/0159299 A1 May 25, 2023

(51) Int. Cl.
*B65H 75/44* (2006.01)
*B65H 75/42* (2006.01)

(52) U.S. Cl.
CPC ..... *B65H 75/4463* (2013.01); *B65H 75/425* (2013.01); *B65H 75/4478* (2013.01); *B65H 2701/33* (2013.01); *B65H 2701/34* (2013.01)

(58) Field of Classification Search
None
See application file for complete search history.

(56) References Cited

U.S. PATENT DOCUMENTS 3,563,481 A * 2/1971 Stahmer ..... B65H 75/38 242/397.3
4,174,809 A * 11/1979 Arlemark ..... A01G 25/095 137/355.2
4,315,522 A * 2/1982 Brown ..... B65H 75/38 137/355.27
4,346,843 A * 8/1982 Long ..... A01G 25/095 285/190
4,896,686 A * 1/1990 Schmidt, Jr. ..... B08B 9/0495 254/323
5,246,181 A * 9/1993 Straub ..... B65H 75/425 254/323
6,059,214 A * 5/2000 Rashidi ..... B60P 3/224 187/229
6,220,292 B1 * 4/2001 Woodling ..... B66C 23/42 137/355.16
7,516,798 B2 * 4/2009 Wood ..... E21B 7/02 166/380
8,784,007 B2 * 7/2014 Wilson ..... B09B 1/004 405/129.95
8,807,465 B2 * 8/2014 Korus ..... B65H 75/4481 239/722
10,150,645 B1 * 12/2018 Pei ..... B65H 75/4463
10,882,716 B1 * 1/2021 Smith ..... H02G 11/02
10,973,180 B2 * 4/2021 Qiu ..... B05B 9/007
2011/0303314 A1 * 12/2011 Blaszczak ..... B65H 75/4478 137/899
2013/0341455 A1 * 12/2013 Worton ..... B65H 49/32 242/557
2015/0129703 A1 * 5/2015 Kucera ..... B65H 75/4486 242/390.8
2017/0197536 A1 * 7/2017 Mayer ..... B60R 19/24
2019/0161315 A1 * 5/2019 Bergan ..... B65H 75/4402
2019/0248621 A1 * 8/2019 Tracey ..... B65H 75/4478
2020/0048030 A1 * 2/2020 Arzola ..... B65H 49/24

* cited by examiner

*Primary Examiner* — William A. Rivera
(74) *Attorney, Agent, or Firm* — Schwegman Lundberg & Woessner, P.A.

(57) ABSTRACT

A reel system can include a reel rotatable around a first axis to receive or deploy a windable line a frame supporting the reel, a base supporting the frame, and a bearing assembly. The bearing assembly can include a first member connected to the base and a second member connected to the frame and rotatably engaged with the first member to enable relative rotation between the frame and the base around a second axis.

16 Claims, 7 Drawing Sheets

ROTATING REEL SYSTEM

BACKGROUND

Reel systems are versatile pieces of equipment useful in a wide variety of industrial, commercial, and domestic applications to compactly store and easily deploy windable lines from a rotatable reel. Reel systems can store, deploy, and retract a flexible line, such as located in a wound or coiled arrangement on or about a rotatable reel. For example, a selected length of the line can be deployed from the rotatable reel via rotation of the reel in a first direction, and subsequently retracted onto the reel via rotation in a second and opposite direction. The reel can be manually rotated, such by pulling on the line or by using a hand crank or other mechanical devices to rotate the reel, or, when a weight of the line or reel would make manual rotation impractical, reel systems can include a motor for power-assisted rotation of the reel.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
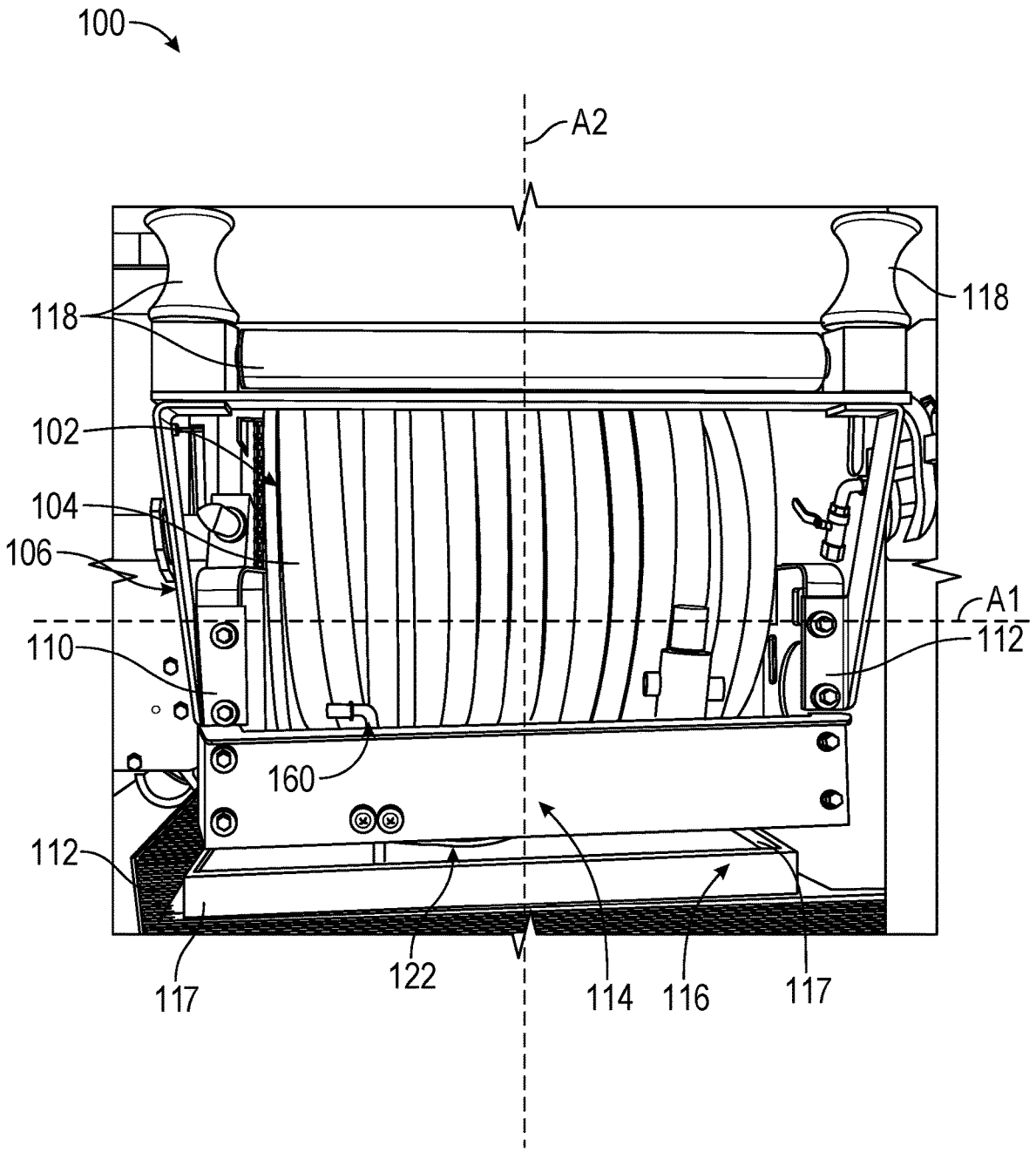
FIG. 1 illustrates a front perspective view of a reel system.

Reel systems can be beneficial to, and are used in, a wide variety of applications in various industries. For example, firetrucks or other rescue vehicles often include several reel systems configured to rapidly deploy water, hydraulic, or air lines, or electrical or steel cabling, in emergency situations. The vehicle can be driven to a location and positioned to help facilitate effective use of available equipment, such as by locating a reel system in a position both easily accessible to a user, and proximal to an emergency site. However, the reel systems configured for such applications include a number of shortcomings. For example, these reel systems are typically fixedly mounted on the vehicle, such as using a base coupled to a frame rotatably supporting the reel. Accordingly, the orientation of the frame with respect to the base and the vehicle is not adjustable.

This can present a significant barrier to rapid deployment or retraction of the various lines that may be used in emergency situations. For example, due the nature of fire or rescue operations, the time or space available at an emergency site is often insufficient to allow for optimal positioning, or to permit repositioning, of the vehicle. As a result, the vehicle is often inadvertently or unavoidably positioned in a manner locating a desired reel system in a position inaccessible to a user. This can result in a difficult and time-consuming deployment or retraction of a line. For example, the line can be deployed or retracted most efficiently, such as using a minimal amount of effort, when the line is deployed along a vector or axis extending generally perpendicular to the axis of rotation of the reel. As such, the amount of effort used to deploy or retract the line increases as the angle formed between the line and the reel deviates from 90 degrees. This can cause the line to become tangled, kinked, or damaged during deployment or retraction and prevent effective use in an emergency situation.

A second user can help to address such issues by acting a guide to limit the angle the line forms with respect to the reel during deployment or retraction of the line. This can slow the process by necessitating communication between the first and the second users. Further, fire hoses or solid steel cables can be heavy and difficult to manage, which can make guiding the line a difficult or dangerous task. Additionally, a second user may not always be available, and the space between the vehicle and a building, for example, may prevent two users from concurrently operating the reel system. One common device used to help address such an issue is a roller guard. Roller guards can be, for example, cylinders rotatably connected to the frame supporting the reel, and can limit the angle the line forms with respect to the reel during deployment or retraction.

For example, a length of the line can extend from the reel along an axis perpendicular to an axis of rotation of the reel to contact a roller guard. The line can wrap around at least a portion of the circumference of the roller guard and extend beyond the roller guard at an angle relative to the length of the line located between the reel and the roller guard. However, roller guards are subject to frequent failures, such as physical breakage, detachment from the frame, or rotatable seizure or binding. Further, the benefits provided by roller guards are limited in operation, as the line becomes increasingly difficult to deploy as the angle formed between the length of line extending beyond the roller guard and the length of line extending between the reel and the roller guard decreases. Further, air or fluid flow through the line can be significantly reduced beyond a certain angle. Therefore, an improved reel system configured for at least the applications set out above is desirable.

The present disclosure can help to address the above issues, among others, such as by providing a reel system capable of enabling a single user to easily and rapidly deploy or retract a length of line from a vehicle, irrespective of the location and orientation of the emergency relative to the vehicle by providing a reel that is rotatable relative to the vehicle. For example, the reel system can include a bearing assembly rotatably coupling a base of the reel to a frame rotatably supporting the reel. The bearing assembly can enable relative rotation between the base and the frame (and therefore the reel and the vehicle) around an axis extending perpendicular to the axis of rotation of the reel. Further, a proximal portion the line can be coupled to one or more rotatable fittings, optionally extending transversely through the bearing assembly, such as to allow the line to be connected to a supply source without limiting rotation of the reel with respect to the vehicle. The reel system can thereby allow a single user to rotate the reel between 0 and 360 degrees relative to the vehicle to deploy or retract the line, such as along an axis extending orthogonally to the axis of rotation of the reel, with a minimal amount of effort.

Therefore, the reel system can significantly reduce the time and the effort required to deploy or retract a line during a fire or rescue operation.

While the above overview discusses examples pertain generally to reel systems reels used on fire or rescue vehicles, discussion of the following systems, devices, or methods are also applicable for use in other applications, such as to other commercial or residential hose or cable reels mounted to vehicles or to buildings. The above overview is intended to provide an overview of subject matter of the present patent application. It is not intended to provide an exclusive or exhaustive explanation of the invention. The description below is included to provide further information about the present patent application.

Figure 2:
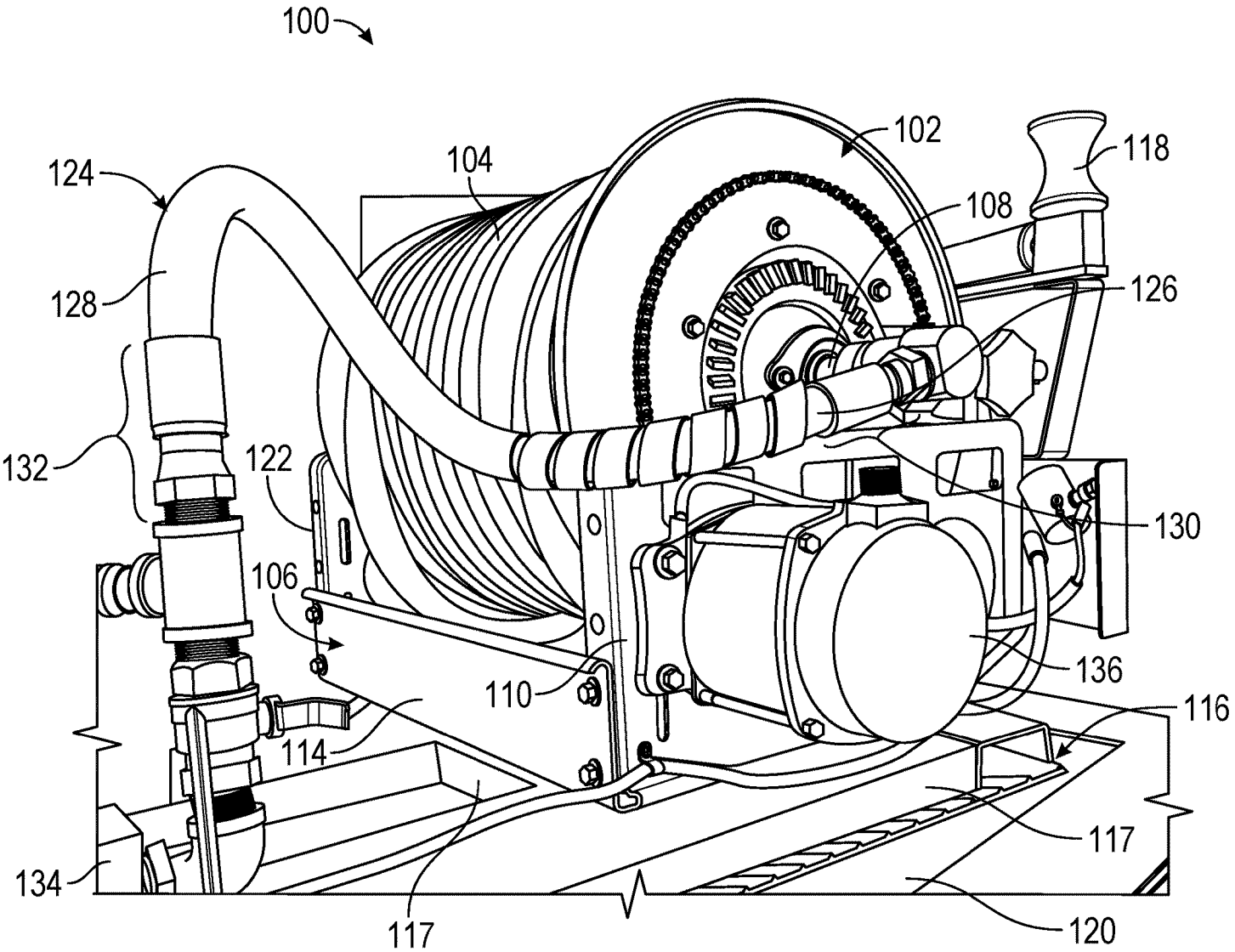
FIG. 2 illustrates a side perspective view of a reel system.

FIG. 1 illustrates a front perspective view of a reel system 100. FIG. 2 illustrates a side perspective view of a reel system 100. FIGS. 1-2 are discussed below concurrently. Also shown in FIGS. 1-2 is a first axis A1 and a second axis A2. The reel system 100 can include a reel 102 and a line 104. The reel 102 can be a rotatable spool or cylinder defining the first A1. For example, the first axis A1 can be both a central axis and the axis of rotation of the reel 102. The line 104 can be various types of windable lines, such as, but not limited to, a flexible water, hydraulic, or air hose, or a solid or stranded cable. The reel 102 can be configured to receive the line 104. For example, the line 104 can be wound or coiled around a circumference of the reel 102. Once received on or otherwise about the reel 102, the line 104 can be deployed via rotation of the reel 102 around the first axis A1 in a first or forward direction, and subsequently retracted via rotation of the reel 102 around the first axis A1 in a second or reverse direction.

The reel system 100 can include a frame 106. The frame 106 can be a structure configured to support the reel 102. For example, the frame 106 can include a reel supply connection 108, a first arm 110, a second arm 112, and crossmembers 114. The reel supply connection 108 can be a hollow or a solid cylinder, such as a hollow shaft, but can form other three-dimensional shapes, such as rectangular, triangular, or hexagonal prisms. The reel supply connection 108 can extend axially through the reel 102 along the first axis A1. The reel 102 can rotate concurrently with, or can rotate around, the reel supply connection 108. The first arm 110 and the second arm 112 can be brackets or other structures extending generally parallel to, and laterally offset from, the first axis A1 and the reel supply connection 108. The first arm 110 and the second arm 112 can be configured to receive opposite portions or ends of the reel supply connection 108 to rotatably support the reel 102 along the first axis A1, such as within axial bores extending transversely through the first arm 110 and the second arm 112. Any of the first arm 110 and the second arm 112, the reel supply connection 108, or the reel 102 can also include or be connected to a friction reducing device, such a ball or needle bearing or a bushing arrangement, to help reduce rotational friction between one or more portions of the reel 102, the reel supply connection 108, or the first arm 110 and second arm 112.

The crossmembers 114 can be hollow or solid beams, such as sections of angle or flat bar stock. The frame 106 can include various numbers of crossmembers 114, such as, but not limited to, 1, 2, 3, 4, 5, or 6 crossmembers 114. The crossmembers 114 can extend laterally between and be secured to (such as with various types of fasteners) the first arm 110 and the second arm 112, such as to increase the torsional or lateral rigidity of the frame 106. The frame 106 can also include one or more roller guards 118. The roller guards 118 can be cylinders or spools rotatably connected to various portions of the frame 106. The roller guards 118 can dictate the angle the line 104 can form with respect to the reel 102 during deployment or retraction of the line 104.

For example, a first length of the line 104 can extend from the reel 102 along an axis perpendicular to the first axis A1 to contact at least a portion of a circumference of the roller guard 118, such that a second length of the line 104 extending beyond the roller guard 118 forms an angle relative to the first length of the line 104. The roller guards 118 can thereby limit lateral or vertical positioning of a first length of the line 104 during deployment or retraction to prevent the line 104, such as to prevent the line 104 from becoming tangled or damaged.

The reel system 100 can include a base 116. The base 116 can generally be a subframe configured to couple the frame 106 to a vehicle 120. The base 116 can include two opposing pairs of beams 117 to form a generally square or rectangular shape. However, the base 116 can form other three-dimensional shapes. The beams can be sections of cylindrical, square, rectangular, or other shapes of tubing, or beams such as sections of angle or flat bar stock. The base 116 can be configured to be secured to a vehicle 120, such as via various types of fasteners. The vehicle 120 can be any vehicle operable to transport the reel system 100 to various locations.

The reel system 100 can include a bearing assembly 122. The bearing assembly 122 can be one or more ball or needle bearings, bushing arrangements, or other friction reducing devices. The bearing assembly 122 can define the second axis A2. For example, the second axis A2 can be both a central axis and the axis of rotation of the bearing assembly 122. The second axis A2 can extend orthogonally to the first axis A1. The bearing assembly 122 can be located between the frame 106 and the base 116, such as to rotatably couple the frame 106 to the base 116. The bearing assembly 122 can thereby enable rotation therebetween the reel 102 and the vehicle 120 around the second axis A2.

In some examples, the reel system 100 can include a supply line 124. The supply line 124 can be a hose, such as configured to provide liquids or gases to the line 104. The supply line 124 can include a first end portion 126 and a second end portion 128. The first end portion 126 and the second end portion 128 can generally be opposite portions of the supply line 124. The supply line 124 can be operably connected to the reel supply connection 108 or to a proximal end of the line 104. For example, the reel system 100 can include a first rotatable fitting 130 and a second rotatable fitting 132. The first rotatable fitting 130 and the second rotatable fitting 132 can be, for example, any of various types of swivel joints such as rotary manifolds or unions. The first rotatable fitting 130 can rotatably couple the first end portion 126 of the supply line 124 to the reel supply connection 108, or to a proximal end of the line 104 extending within the reel supply connection 108.

The reel system 100 can include a supply source 134 that can be, for example, but not limited to, a pump or compressor coupled to a reservoir or other components located on or within the vehicle 120. The second rotatable fitting 132 can rotatably couple the supply line 124 to the supply source 134. The supply line 124, the first rotatable fitting 130, and the second rotatable fitting 132 can thereby operably couple the line 104 to the supply source 134 to supply the line 104 with liquids or gases without limiting relative rotation between the reel 102 and the vehicle 120. The supply source can optionally be connected to and supported by the base 116.

The reel system 100 can include a motor 136. The motor 136 can be, for example, but not limited to, an electric or pneumatic motor. The motor 136 can be connected to the reel such that the motor 136 can be configured to rotate the reel 102, such as via a user input to the motor 136. For example, the reel 102 and the motor 136 can together define a drive system, such as a gear or shaft driven arrangement, to allow the motor to engage with and rotate the reel 102. The reel system can also include a locking system 160. The locking system 160 can be configured to allow a user to selectively prevent rotation of the frame 106 relative to the base 116, such when the reel 102 is positioned at a desired orientation.

The reel system 100 can thereby be capable of enabling a user to easily and rapidly deploy or retract the line 104, irrespective of a starting orientation between the reel 102 and the vehicle 120. For example, the bearing assembly 122, the first rotatable fitting 130, and the second rotatable fitting 132 can allow the line 104 to be operably coupled to the supply source 134 without limiting rotation of the frame 106 with respect to the base 116. Accordingly, the reel system 100 can allow a user to rotate the reel 102 between 0 and 360 degrees relative to the vehicle 120 to deploy or retract the line 104 with a minimal amount of effort, such as by extending the line 104 along an axis perpendicular to the axis A1. Therefore, the reel system 100 can significantly reduce the time and the effort required to deploy or retract a line during a fire or rescue operation.

Figure 3:
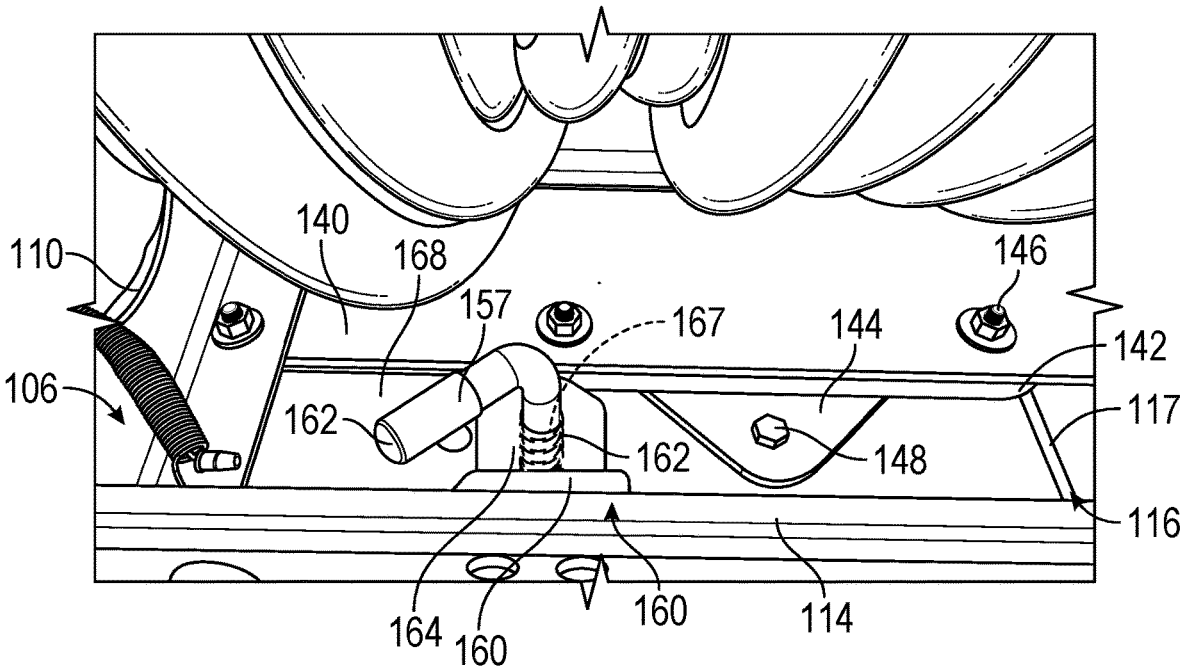
FIG. 3 illustrates an isometric front view of a base and a locking system of a reel system.
Figure 4:
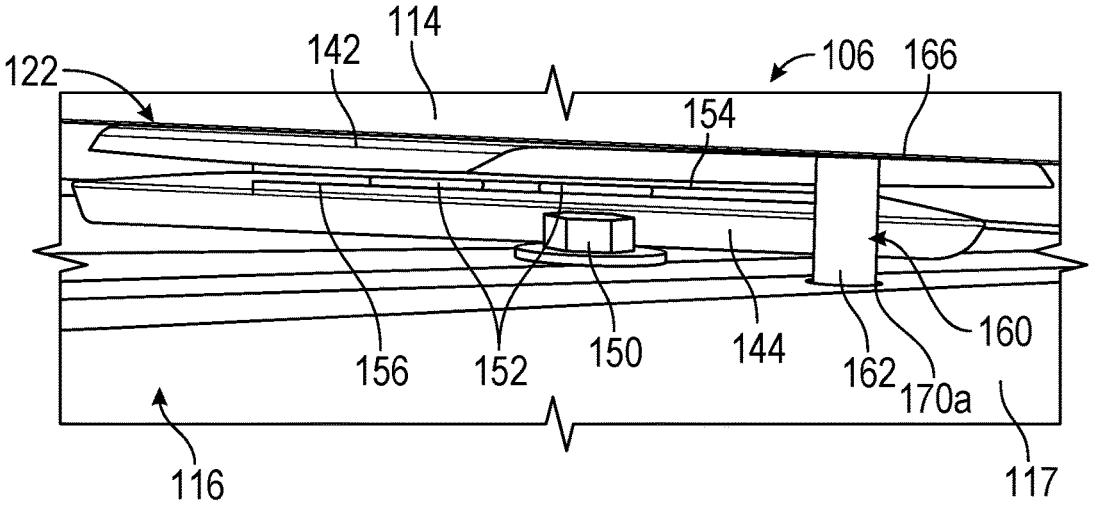
FIG. 4 illustrates a side isometric view of a bearing assembly of a reel system.
Figure 5:
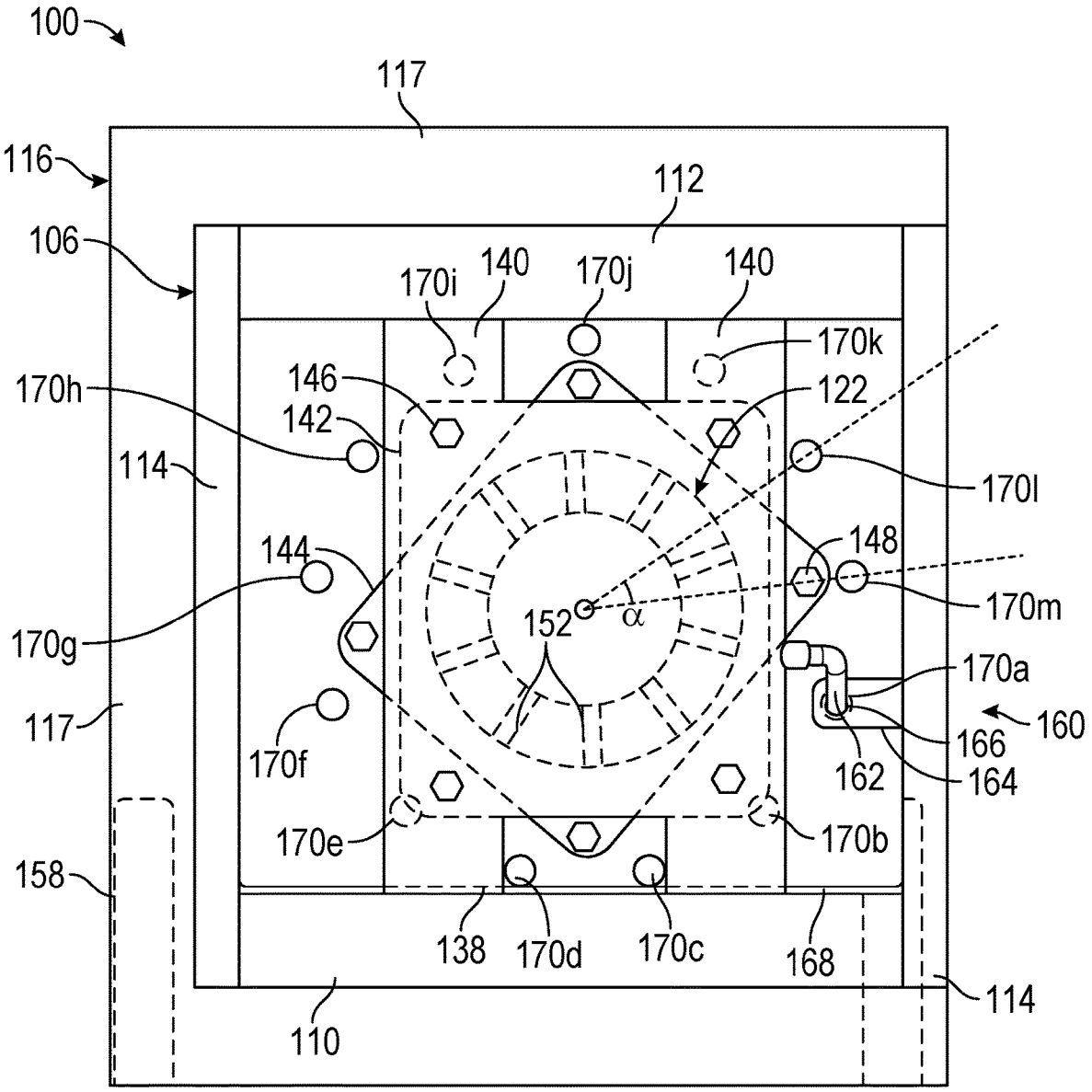
FIG. 5 illustrates a top isometric view of a frame and base of a reel system.

FIG. 3 illustrates a perspective front view of a base 116 and a locking system 160 of a reel system 100. In FIG. 3, a spring 167 is shown in phantom. FIG. 4 illustrates a side isometric view of a bearing assembly 122 of a reel system 100. FIG. 5 illustrates a top isometric view of a frame 106 and base 116 of a reel system 100 with the reel 102 removed. In FIG. 5, a first member 142 and portions of a second member 144 are shown in phantom. FIGS. 3-5 are discussed below concurrently with reference to the reel system 100 shown in, and as described with regard to, FIGS. 1-2 above; FIGS. 3-5 show additional details of the reel system 100.

As shown in FIG. 5, the frame 106 can define an opening 138. The opening 138 can be as a gap or space between any of the first arm 110, the second arm 112, or at least one of the crossmembers 114. The frame 106 can also include plates 140. The plates 140 can be hollow or solid plates, such as sections of angle or flat bar stock. The plates 140 can be lowermost portions of the of the frame 106, relative to the reel 102 or the roller guards 118. The plates 140 can extend laterally between and can be secured to the first arm 110 and the second arm 112, such as with one or more fasteners.

As shown in FIGS. 3-5, the bearing assembly 122 can include the first member 142 and the second member 144. The first member 142 and the second member 144 can generally be square or rectangular plates; but can also form other three-dimensional shapes such as cylindrical prisms or triangular prisms. Each of the first member 142 and the second member 144 can define various bores extending generally parallel to the second axis A2, such, but not limited, to 1, 2, 3, 4, 5 or 6 bores. The reel system 100 can include at least one first fastener 146 and at least one second fastener 148. The first fastener 146 and the second fastener 148 can be, for example, bolts, screws, rivets, or still other types of fasteners.

The first fastener 146 can be a fastener configured, such as being sized and shaped to contact and extend through any of the bores in the plates 140 and the first member 142 to secure the first member 142 to the plates 140 of the frame 106. As such, the reel system 100 can include a number of first fasteners 146 corresponding the number of bores the plates 140 collectively define. The second fastener 148 can be configured, such as being sized and shaped, to contact and extend through bores in the base 116 (e.g. the beams 117 or a base plate 168 discussed below) and the second member 144 to secure the base 116 to the second member 144. As such, the reel system 100 can include a number of second fasteners 148 corresponding to the number of bores the base 116 collectively defines.

The first fastener 146 and the second fastener 148 can be similar or different relative to each other, such as to contact and extend through bores of varying dimensions, such as between the bores of the plates 140 or the bores of the base 116. The first fastener 146 and the second fastener 148 can thereby couple the frame 106 and the base 116 to the bearing assembly 122, such that the first member 142 and the second member 144 extend parallel to, and are laterally offset from, the first axis A1. The reel system 100 can further include at least one third fastener 150 (shown in FIG. 4). The third fastener 150 can be similar or different of the first fasteners 146 and the second fasteners 148. The third fastener 150 can be configured, such as being sized and shaped, to contact and extend through the bores in the beams 117 of the base 116 to engage a vehicle, such as the vehicle 120 in FIGS. 1-2. As such, the reel system 100 can include a number of third fasteners 150 corresponding to the number of bores the beams 117 of the base 116 collectively define.

As shown in FIGS. 4-5, the bearing assembly 122 can include a plurality of bearings 152 such as including ball or needle bearings, bushings, various other friction reducing components, or any combination thereof. The bearings 152 can be located between the first member 142 and the second member 144. For example, each of the bearings 152 can concurrently contact a lower surface of the first member 142, such as facing away from the reel 102, and an upper surface of the second member 144, such as facing toward the reel 102, to limit a vertical position of each of the bearings 152.

The first member 142 can include a first protrusion 154 and the second member 144 can include a second protrusion 156. The first protrusion 154 and the second protrusion 156 can extend or otherwise project outwardly from each of the first member 142 and the second member 144, respectively, to form a radial, annular, or otherwise circular arrangement. Each of the first protrusion 154 and the second protrusion 156 can define one or more surfaces configured to contact and retain portions of each of the bearings 152, such as to guide each of the bearings 152 in a circular path during rotation. As such, the first member 142 and the second member 144 can together collectively function as inner and outer bearing races for each of the bearings 152. For example, a user can apply a force to any portion of the frame 106 to cause the bearings 152 located between first member 142 including the first protrusion 154 to rotate in a first or second direction.

During such rotation, each of the bearings 152 can contact, for example, various surfaces of the first protrusion 154, a lower surface of the first member 142, various surfaces of the second protrusion 156, and an upper surface of the second member 144 to limit vertical and horizontal translation of the bearings 152, such as to ensure the bearings 152, and thereby the first member 142 and the second member 144, rotate around the second axis A2. The bearing assembly 122 can thereby allow a user to rotate the frame 106 with respect to the base 116. The reel system 100 can also include slots 158. The slots 158 can generally be longitudinal openings or otherwise hollow sections extending within the base 116. The slots 158 can extend parallel to, and laterally offset from, the second axis A2. The slots 158 can be configured to receive, for example, forks or lifting arms of a forklift, such as to allow a forklift or other machine to lift, transport, and place the reel system 100 onto the vehicle 120 or to remove the reel system 100 therefrom.

The reel system 100 can include a locking system 160. The locking system 160 can be configured to allow a user to selectively prevent rotation of the frame 106 relative to the base 116, such when the reel 102 is positioned at a desired orientation. The locking system 160 can include a pin 162. The pin 162 can be a solid or hollow cylindrical body forming various shapes, such as an L, T, or D shape. The pin 162 can be slidably, rotatably, pivotably connected to the frame 106, such as to be adjustably positionable with respect to the frame 106 and the base 116.

The locking system 160 can also include a bracket 164 (FIGS. 3 & 5). The bracket 164 can be secured to the frame 106 via welding or various types of fasteners to extend inwardly or away from the crossmember 114, such as generally toward the bearings 152. The bracket 164 can define a bracket bore 166. The bracket bore 166 can be sized and shaped to contact and receive at least a portion of the pin 162 to locate the pin 162 with respect to the frame 106. For example, when received within the bracket bore 166, the pin 162 can extend parallel to, and laterally offset from, the second axis A2. The bracket 164 can thereby connect the pin 162 to the frame 106, such as to allow the pin 162 to be positioned in a locked and in an unlocked position.

As shown in FIG. 5, the base 116 can also include a base plate 168 defining apertures 170*a*-170*x* (collectively referred to as apertures 170*a*-170*x*). The base plate 168 can be hollow or a solid plate, such as a section of sheet metal or flat bar stock. The base plate 168 can be secured to the base 116, such as to extend parallel to, and laterally offset from, the first axis A1. The apertures 170*a*-170*x* can extend vertically or otherwise transversely through the frame 106, such as parallel to, and laterally offset from, the second axis A2. The apertures 170*a*-170*x* can be configured, such as by being sized and shaped, to contact and receive at least a portion of the pin 162.

The base plate 168 can define, for example, but not limited to, 1, 2, 3, 4, 5, 6, 7, 8, 9, 10, 11, 12, 13, 14, 15, 16, 17, 18, 19, 20, 24, 25, or 30 apertures 170*a*-170*x*. The apertures 170*a*-170*x* can form an annular, radial, or otherwise circular arrangement. The apertures 170*a*-170*x* can be radially spaced, relative to one another, such as depending on the specific number of apertures 170*x* the base plate 168 defines. Angle $\alpha$ can represent the radial spacing between each of the apertures 170*a*-170*x* with respect to one another. For example, the angle $\alpha$ can be configured to allow spacing angles of, but not limited to, about 10-50 degrees, 51-100 degrees, 101-150, or 151-180 degrees. The apertures 170*a*-170*x* can thereby allow the locking system 160 to selectively limit relative rotation between the frame 106 and the base 116 when the reel 102 is positioned at any of various desired orientations with respect to the base 116.

In the operation of at least one example, the pin 162 can be positioned in an unlocked position. For example, the pin 162 can be inserted into, or translated vertically within, the bracket bore 166 such that the pin 162 does not make contact with the base plate 168, or otherwise extend into or engage of any of the apertures 170*a*-170*x*. Thus, in the unlocked position, the locking system 160 can thereby allow relative rotation between the frame 106 and the base 116. The pin 162 can also be positioned in a locked position. For example, the pin 162 can be vertically translated within bracket bore 166 such that at least a portion of the pin 162 extends into, or otherwise engages, an aperture in axial alignment with the bracket bore 166, such as the aperture 170*a*. In some examples, the pin 162 can be vertically translated downward through the bracket bore 166 until a portion of the pin 162, such the handle 165 contacts the bracket 164 to limit further translation of the pin 162. The pin 162 and the handle 165 can have an L-shape, a T-shape, or the like.

Accordingly, when the pin 162 is positioned in the locked position, relative rotation between the frame 106 and the base 116 is limited because portions of the pin 162 extend concurrently through both the bracket 164 (connected to the frame 106) and the base plate 168 (fixedly connected to the base 116). That is, in the locked position, the pin 162 engages the bracket and the base plate 168 to limit relative rotation of the frame 106 with respect to the base 116. The locking system 160 can thereby limit relative rotation between the reel 102 and the vehicle 120 when the pin 162 is in the locked position and the locking system 160 can allow relative rotation between the reel 102 and the vehicle 120 when the pin 162 is in the unlocked position, allowing an operator to rotate the reel 102 to a desired orientation with respect to. After an operators positions the reel 102 as desired, the pin 162 can be moved to the locked position to limit rotation of the reel 102 with respect to the base 116 and the vehicle 120 to allow the operator to use the reel 102, such as to unwind or otherwise position the line 104.

In some examples, the pin 162 can be spring-biased. For example, the locking system 160 can include a spring 167 (FIG. 3) positioned to exert pressure on the pin 162 when at least a portion of the pin 162 is received within the bracket bore 166. In such an example, the pin 162 can be biased downward toward the base 116, such as to cause the pin 162 to normally remain in contact with the base plate 168 to bias the pin 162 to a locked position. In such an example, when the bracket bore 166 is rotated into axial alignment with the aperture 170*a*, a portion of the pin 162 can automatically extend into or through the aperture 170*a* under spring pressure. In this way, the pin 162 can automatically lock the position of the reel 102 with respect to the vehicle to help allow an operator to quickly lock the reel 102 in place after adjusting a rotational position of the reel 102 with respect to the base 116 and the vehicle 120.

The reel system 100 can thereby allow a user to rotate and secure the reel 102 at any of various orientations with respect to the vehicle 120. For example, a user can apply a force or pressure to any portion of the frame 806 to rotate the bearings (e.g., 152 of the bearing assembly 122), and thereby the reel 102, into a desired orientation, such as to enable convenient deployment or retraction of the line 104. The locking system 860 can be operated to limit rotation between the frame 106 and the base 116 to maintain the desired orientation of the reel 102, such as via translation of the pin 162 through the bracket bore (e.g., 166) and into the aperture (e.g., 170*a*) to help facilitate stable and reliable deployment or retraction of the line 104. Optionally, the locking system 160 can include an actuator, such as an electric, pneumatic, hydraulic, or other powered actuators, as discussed in further detail below with respect to FIG. 8.

The reel system 100, including any component thereof, such as the reel 102, the line 104, the frame 106, the base 116, or the bearing assembly 122 can each be made from, but not limited to, steel, aluminum, or other metals via metallic molding or machining. Alternatively, the reel system 100, including any component thereof, such as the reel 102, the line 104, the frame 106, the base 116, or the bearing assembly 122 can each be made from various other materials such as plastics, composites, ceramics, or rubber.

Figure 6A:
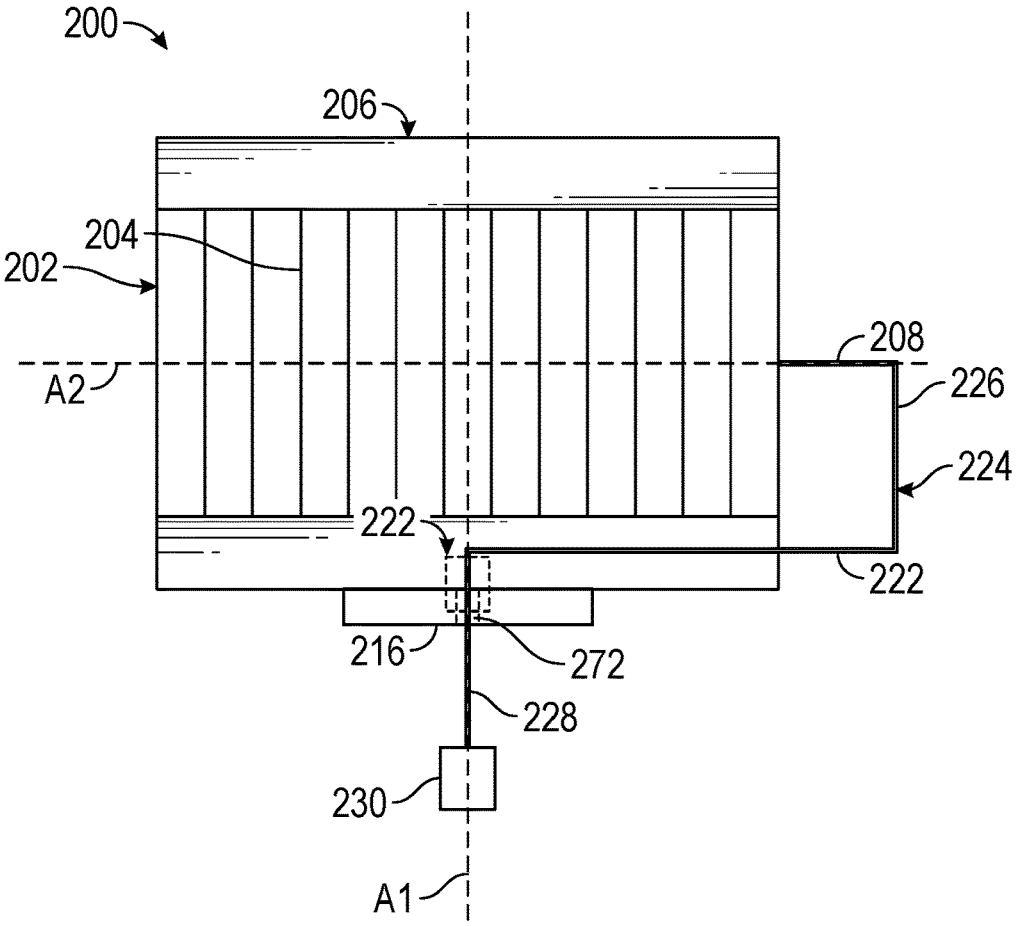
FIG. 6A illustrates a top isometric view of a reel system.
Figure 6B:
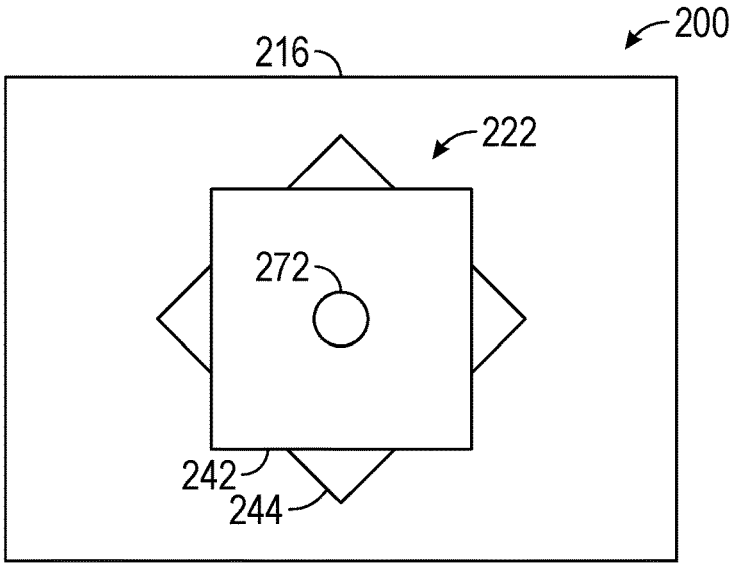
FIG. 6B illustrates a bottom isometric view of a reel system.

FIG. 6A illustrates a top isometric view of a reel system 200, in accordance with at least one example of the present application. FIG. 6B illustrates a bottom isometric view of a reel system 200, in accordance with at least one example of the present application. FIGS. 6A-6B are discussed below concurrently. The reel system 200 can include any of the components of the reel system 100 shown in, and discussed with reference to, FIGS. 1-5 above and the reel system 100 discussed above can be modified to include the components of the reel system 200

The reel system 200 can include a supply line 224. The supply line 224 can be a flexible hose, a rigid hard line, or otherwise a semi-rigid tubular body configured to provide liquids or gases to the line 204. The supply line 224 can include a first end portion 226 and a second end portion 228. The first end portion 226 and the second end portion 228 can be opposite segments or portions of the supply line 224. The first end portion 226 can be coupled to a reel supply connection 208 to operably couple the supply line 224 to the line 204.

The reel system 200 can include a bearing assembly 222. The bearing assembly 222 can define a passage 272 defining, radially encompassing, or otherwise aligned with, the second axis A2. For example, the passage 272 can be a tubular or cylindrical channel extending vertically or otherwise transversely through the bearing assembly 222. The passage 272 can extend though the first member 142, the first protrusion 154, the bearings 152, the second protrusion 156, and the second member 144. The passage 272 can be configured to allow the supply line 224 of the reel system 200 to pass through the bearing assembly 222. For example, the passage 272 can be sized and shaped to receive at least a portion of the supply line 224. Therefore, as the supply line 224 can extend centrally through the bearing assembly 222 along the second axis A2, the frame 106 and the first member 142 of the bearing assembly 222 can rotate around the supply line 224. The second end portion 8 of the supply line 224 can be coupled to the first rotatable fitting 230. The first rotatable fitting 230 can rotatably couple the second end portion 228 to a supply source, such as the supply source 134.

The passage 272 can thereby allow the reel 202 and the frame 206 to rotate between 0 and 360 degrees with respect to the base 216. This can increase the ease of operation of the reel system 200 and increase the life of the supply line 224. For example, the reel 202 can be rotated between 0 and 360 degrees without risk of over-extending, or excessively stretching or stressing the supply line 224 leading to tearing or premature failure of the supply line 224. Further, as the supply line 224 can be a hard line between the reel supply connection 208 and the first rotatable fitting 230, the supply line 224 can be more durable than a flexible hose, such as the supply line 124. The reel system 200 can also improve protection of the supply line 224 by locating the supply line closer to the reel 202, such as within or between various components of the frame 206, bearing assembly 222, or the base 216. Also, the reel system 200 can allow for full rotation of the reel 202 with respect to the base 216 and a vehicle, even when the line 204 is extended, helping to further improve mobility and usability of the reel 202 and the line 204.

Figure 7:
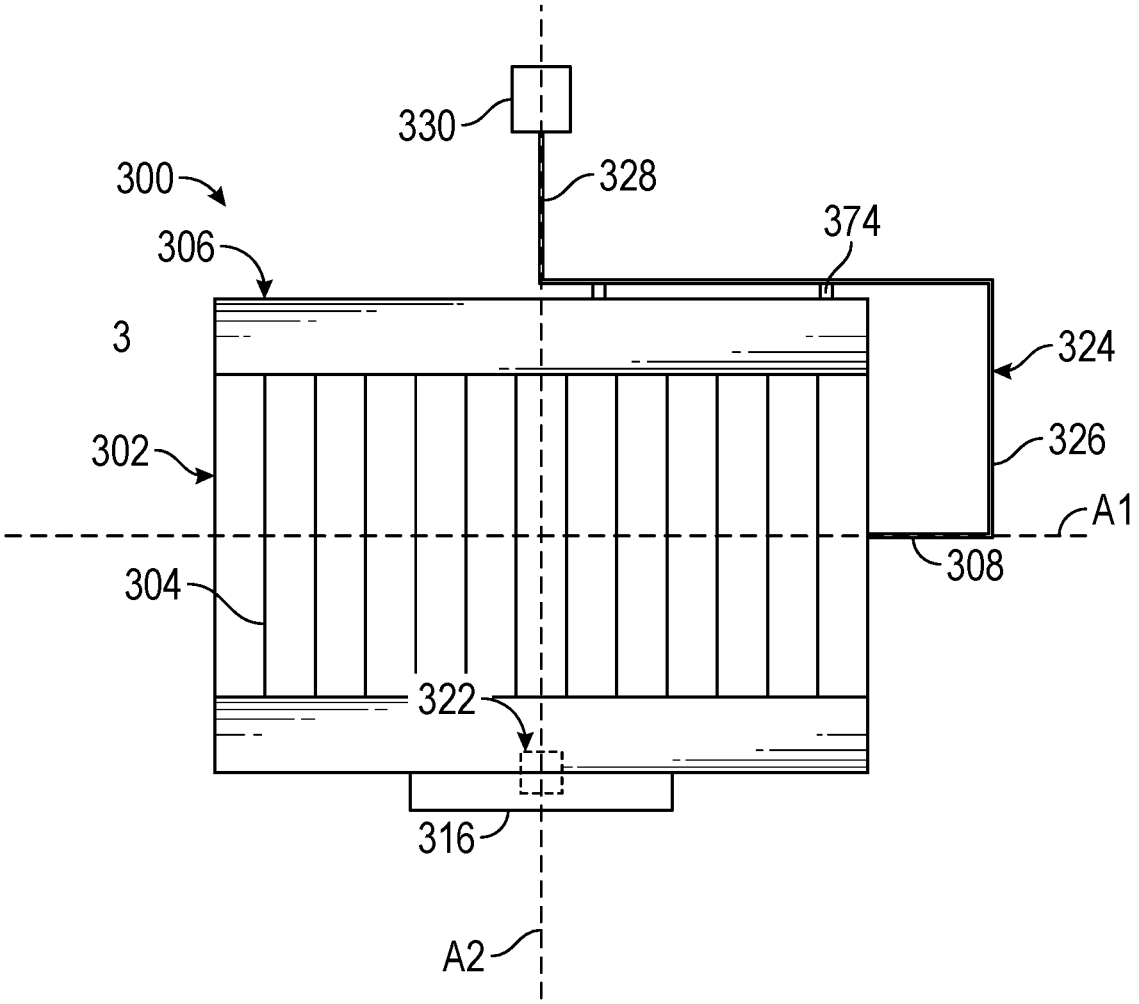
FIG. 7 illustrates a top isometric view of a reel system.

FIG. 7 illustrates a top isometric view of a reel system 300, in accordance with at least one example of the present application. The reel system 300 can include any of the components of the reel system 100 shown in, and discussed with reference to, FIGS. 1-5 above and the reel system 100 discussed above can be modified to include the components of the reel system 300. The reel system 300 can include a supply line 324. The supply line 324 can be a flexible hose, a rigid hard line, or otherwise a semi-rigid tubular body configured to provide liquids or gases to the line 304. The supply line 324 can include a first end portion 326 and a second end portion 328. The first end portion 326 and the second end portion 328 can be opposite segments or portions of the supply line 324.

The first end portion 326 can be coupled to the reel supply connection 308 to operably couple the supply line 324 to the line 304. The frame 306 can include one or more guides 374. The guides 374 can be brackets or other structures extending generally parallel to, and laterally offset from, the first axis A1 or the second axis A2. The guides 374 can be configured to receive portions of the supply line 324 to guide, support, and locate the supply line 324 with respect to the reel 102, such as within axial bores extending transversely through the guides 374. The guides 374 can be secured to the frame 306 via welding or various types of fasteners to extend outwardly, such as generally away from the reel 102, or inwardly, such as generally toward the reel 102. In contrast to the reel system 100, the first rotatable fitting 330 can be coupled to the second end portion 328 of the supply line 324. A first rotatable fitting 330 can rotatably couple the second end portion 328 to a supply source, such as the supply source 134. The guides 374 can thereby allow the reel 302 and the frame 306 to rotate between 0 and 360 degrees with respect to the base 316. This can increase the ease of operation of the reel system 300 and increase the life of the supply line 324.

For example, the reel 302 can be rotated between 0 and 360 degrees without risk of over-extending, or excessively stretching or stressing the supply line 324 leading to tearing or premature failure of the supply line 324. Further, as the supply line 324 can be a hard line between the reel supply connection 308 and the first rotatable fitting 330, the supply line 324 can be more durable than a flexible hose, such as the supply line 124. The reel system 300 can also improve protection of the supply line 324 by locating the supply line closer to the reel 302, such as along or between various components of the frame 306. Also, the reel system 300 can allow for full rotation of the reel 302 with respect to the base 316 and a vehicle, even when the line 304 is extended, helping to further improve mobility and usability of the reel 302 and the line 304.

Figure 8:
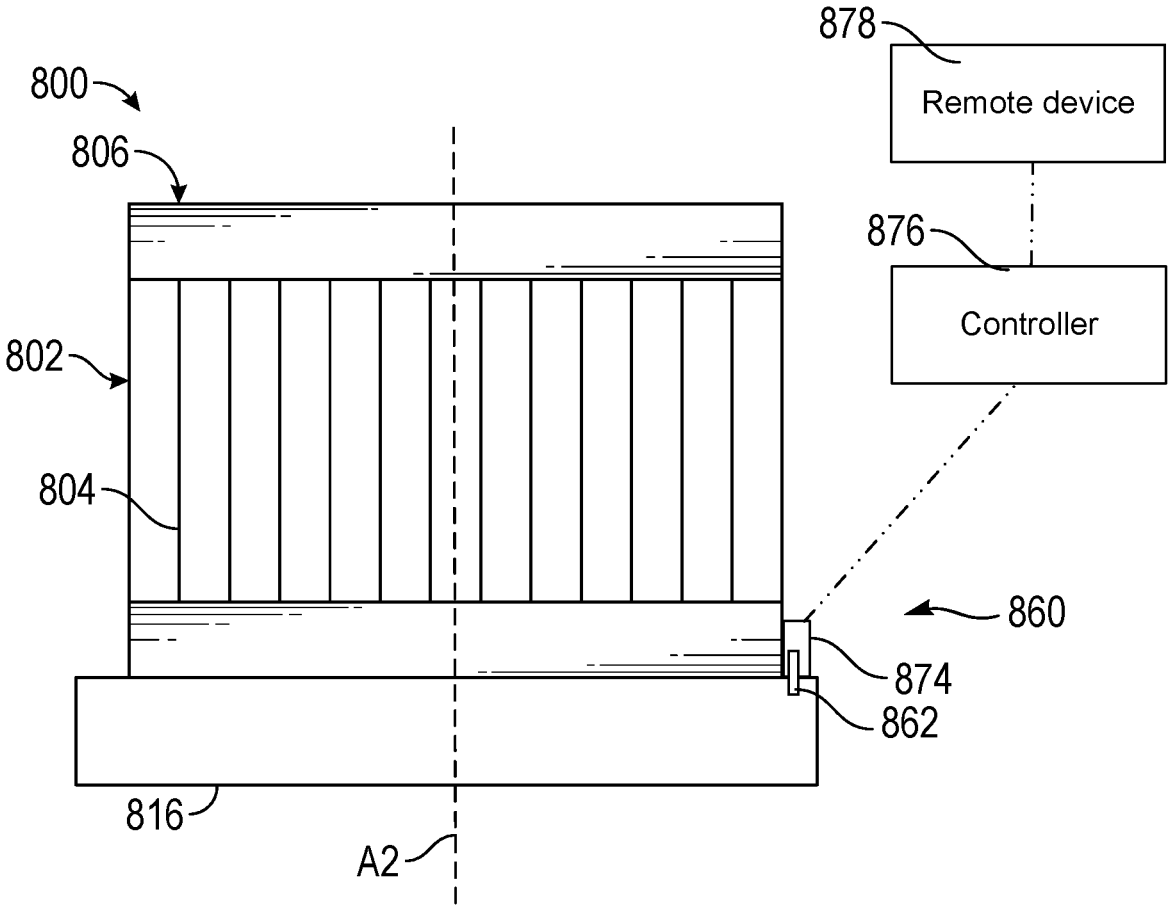
FIG. 8 illustrates a schematic of a reel system.

FIG. 8 illustrates a schematic of a reel system 800. The reel system 800 can be similar to any of those discussed above. The reel system 800 can differ in that it can include an actuator for locking the reel with respect to its base. Any of the systems discussed above or below can be modified to include such a system.

The reel system 800 can include a reel 802, which can be similar to those discussed above and can include a line 804 supported by the reel 802 and dispensable thereby. The reel 802 can be supported by a frame 806 similar to those discussed above. The reel 802 can be supported by a base 816, which can be attachable to a vehicle or other surface (e.g., ground, skid, platform, etc.).

The reel system 800 can also include a locking system 860 including a pin 862 and an actuator 874. The pin 862 can be similar to the pin 162 discussed above in that it can be attached to the frame 806 and can be movable between a locked position and an unlocked position. In the locked position, the pin 862 can be engaged with a bore of the base 816 to limit rotation of the reel 802 with respect to the base 816. In the unlocked position, the pin 862 can be disengaged from the base 816 such that the frame 806 and the reel 802 are free to rotate about the bearing about the axis A2.

The 874 can be any actuator operable to move the pin 862 between the locked and the unlocked position. For example, the 874 can be an electric, pneumatic, hydraulic, magnetic, rotary, piezoelectric, or other powered actuator, such as a solenoid, servo, or the like.

The reel system 800 can also include a controller 876, which can be a programmable controller, such as a single or multi-board computer, a direct digital controller (DDC), a programmable logic controller (PLC), or the like. In other examples the controller 876 can be any computing device, such as a handheld computer, for example, a smart phone, a tablet, a laptop, a desktop computer, or any other computing device including a processor, memory, and communication capabilities. The reel system 800 can also include a remote device, which can be one or more of the devices discussed above with respect to the controller 876. The actuator 874 and the remote device 878 can be in communication with the controller 876 such as through a wired or wireless connection, such as Bluetooth, near field communication (NEC), plain Old Telephone (POTS) networks, or other wireless data networks (e.g., 3G, 4G LTE/LTE-A, WiMax, 5G networks).

The actuator 874 can be configured to vertically translate the pin 862, such as via a user input to the actuator. In operation, the actuator can allow a user to translate the pin between the unlocked and the locked position without manually engaging with the pin 862. For example, a user can use the remote device 878 or the controller 876 to transmit a lock signal to the actuator 874 to move the pin 862 to the locked position or can transmit an unlock signal to the actuator 874 to move the pin 862 to the unlocked position. The locking system 860, the controller 876, and the remote device 878 can thereby allow a user to remotely control the locking system 860 to lock and unlock the reel 802, which can limit user engagement with moving parts and can help to speed up deployment of the line 804, which can be important during certain operations, such as fire extinguishing operations.

Any of the above examples of the reel systems 100-800 shown in and described with regard to FIGS. 1-8 above can be used in a method of deploying a windable line from a rotatable reel of a reel system located on a vehicle. For example, a first step of the method can include deploying at least a portion of the windable line to define a first line vector by rotating the reel around a first axis of rotation, the first line vector extending substantially orthogonally to the first axis of rotation. A second step of the method can include deploying at least a portion of the windable line to define a second line vector by rotating the reel around the first axis of rotation, the second line vector extending substantially orthogonally to the first axis of rotation, wherein the second line vector extends at an acute or obtuse angle relative to the first line vector.

In some examples, the first and the second steps of the method can be accomplished concurrently, such as via rotation of a first member of a bearing assembly around the second axis of rotation during rotation of the reel around the first axis of rotation. In some examples, the second step of the method can include rotating a first member of a bearing assembly around the second axis of rotation such that the second vector extends orthogonally to the first axis of rotation. In still further examples, the second step of the method can include operating a locking system to subsequently prevent relative rotation between the reel and the vehicle, such as when the second vector extends orthogonally to the first axis of rotation.

The discussed steps or operations can be performed in parallel or in a different sequence without materially impacting other operations. The method as discussed includes operations that can be performed by multiple different actors, devices, and/or systems. It is understood that subsets of the operations discussed in the method can be attributable to a single actor device, or system, and could be considered a separate standalone process or method.

The foregoing systems and devices, etc. are merely illustrative of the components, interconnections, communications, functions, etc. that can be employed in carrying out examples in accordance with this disclosure. Different types and combinations of sensor or other portable electronics devices, computers including clients and servers, implants, and other systems and devices can be employed in examples according to this disclosure.

NOTES AND EXAMPLES

The following, non-limiting examples, detail certain aspects of the present subject matter to solve the challenges and provide the benefits discussed herein, among others.

Example 1 is a reel system comprising: a reel rotatable around a first axis to receive or deploy a windable line; a frame supporting the reel; a base supporting the frame; and a bearing assembly including: a first member connected to the base; and a second member connected to the frame and rotatably engaged with the first member to enable relative between the frame and the base around a second axis.

In Example 2, the subject matter of Example 1 includes, a supply line connected to the windable line; and a first rotatable fitting connected to the supply line.

In Example 3, the subject matter of Example 2 includes, wherein the first rotatable fitting is coaxial with first axis.

In Example 4, the subject matter of Example 3 includes, wherein the supply line extends through the bearing assembly.

In Example 5, the subject matter of Examples 2-4 includes, a supply source connected to the supply line; and a second rotatable fitting connected to the supply line.

In Example 6, the subject matter of Example 5 includes, wherein the second rotatable fitting is coaxial with second axis.

In Example 7, the subject matter of Examples 1-6 includes, a locking system operable to limit relative rotation of the reel and the frame with respect to the base.

In Example 8, the subject matter of Example 7 includes, wherein the locking system includes a pin connected to the frame, the pin movable between an unlocked position where the reel and the frame are rotatable with respect to the base, and a locked position where relative rotation of the reel and the frame with respect to the base is limited.

In Example 9, the subject matter of Example 8 includes, wherein the pin is biased to the locked position.

In Example 10, the subject matter of Examples 8-9 includes, an actuator connected to the pin, the actuator operable to move the pin between the unlocked position and the locked position.

In Example 11, the subject matter of Examples 8-10 includes, wherein the base defines a plurality of apertures configured to receive the pin in the locked position, the plurality of apertures located in an annular arrangement around the second axis.

In Example 12, the subject matter of Example 11 includes, wherein each of the plurality of apertures are located between about 15 and 50 degrees with respect to one other.

Example 13 is a reel system comprising: a reel rotatable around a first axis to receive or deploy a windable line; a frame supporting the reel; a base supporting the frame; and a bearing assembly connected to the frame and rotatably engaged with the base to enable relative rotation between the base and the frame around a second axis.

In Example 14, the subject matter of Example 13 includes, a supply line connected to the windable line; and a first rotatable fitting connected to the supply line and coaxial with first axis.

In Example 15, the subject matter of Example 14 includes, a supply source connected to the supply line; and a second rotatable fitting connected to the supply line.

In Example 16, the subject matter of Example 15 includes, wherein the base is configured to couple the reel system to a mobile vehicle including the supply source.

In Example 17, the subject matter of Examples 13-16 includes, wherein the second axis is perpendicular to the first axis.

In Example 18, the subject matter of Examples 13-17 includes, wherein the windable line is a solid or a stranded cable.

Example 19 is a reel system comprising: a reel rotatable around a first axis to receive or deploy a windable line; a frame supporting the reel and including: a first arm and a second arm, the first arm laterally spaced from second arm along the first axis; a tubular shaft extending between the first arm and the second arm and rotatably supporting the reel along the first axis; and a plate connecting the first arm to the second arm, the plate extending parallel to, and laterally offset from, the first axis; a base securable to a vehicle and supporting the frame; a bearing assembly including: a first member connected to the plate of the frame; a second member connected to the base and rotatably engaged with the first member to enable relative rotation of the base with respect to the frame and the reel around a second axis; and a supply line connected to the windable line to connect the windable line to a supply source.

In Example 20, the subject matter of Example 19 includes, a locking system operable to limit relative rotation of the reel and the frame with respect to the base, the locking system including a pin connected to the frame, the pin movable between an unlocked position where the reel and the frame are rotatable with respect to the base, and a locked position where relative rotation of the reel and the frame with respect to the base is limited.

Example 21 is at least one machine-readable medium including instructions that, when executed by processing circuitry, cause the processing circuitry to perform operations to implement of any of Examples 1-20.

Example 22 is an apparatus comprising means to implement of any of Examples 1-20.

Example 23 is a system to implement of any of Examples 1-20.

Example 24 is a method to implement of any of Examples 1-20.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided.

Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein. In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure.

This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A reel system comprising:

a reel rotatable around a first axis to receive or deploy a windable line;

a frame supporting the reel and including:

a first arm and a second arm, the first arm laterally spaced from second arm along the first axis;

a tubular shaft extending between the first arm and the second arm and rotatably supporting the reel along the first axis; and a plate connecting the first arm to the second arm, the plate extending parallel to, and laterally offset from, the first axis;

a base securable to a vehicle and supporting the frame;

a bearing assembly including:

a first member connected to the plate of the frame;

a second member connected to the base and rotatably engaged with the first member to enable relative rotation of the base with respect to the frame and the reel around a second axis; and a supply line connected to the windable line to connect the windable line to a supply source;

a locking system comprising:

a pin connected to the frame, the pin movable between an unlocked position where the reel and the frame are rotatable with respect to the base, and a locked position where relative rotation of the reel and the frame with respect to the base is limited; and an actuator operable to move the pin between the locked position and the unlocked position; and a controller in communication with the actuator to operate the actuator to move the pin based on a received lock signal or a received unlock signal.

2. The reel system of claim 1, wherein the supply line extends through the bearing assembly.

3. The reel system of claim 1, further comprising:

a first rotatable fitting connected to the supply line to allow the reel and the frame to rotate with respect to the base about the second axis when the supply line is connected to the supply source; and a second rotatable fitting connected to the supply line.

4. The reel system of claim 3, wherein the first rotatable fitting is coaxial with second axis.

5. The reel system of claim 1, further comprising a locking system operable to limit relative rotation of the reel and the frame with respect to the base.

6. The reel system of claim 5, wherein the locking system includes a pin connected to the frame, the pin movable between an unlocked position where the reel and the frame are rotatable with respect to the base, and a locked position where relative rotation of the reel and the frame with respect to the base is limited.

7. The reel system of claim 6, wherein the pin is biased to the locked position.

8. The reel system of claim 6, further comprising an actuator connected to the pin, the actuator operable to move the pin between the unlocked position and the locked position.

9. The reel system of claim 6, wherein the base defines a plurality of apertures configured to receive the pin in the locked position, the plurality of apertures located in an annular arrangement around the second axis.

10. The reel system of claim 9, wherein each of the plurality of apertures are located between about 15 and 50 degrees with respect to one other.

11. The reel system of claim 1, wherein the base is configured to couple the reel system to a mobile vehicle including the supply source.

12. The reel system of claim 1, wherein the second axis is perpendicular and orthogonal to the first axis.

13. The reel system of claim 1, wherein the bearing assembly defines a passage extending therethrough, the supply line including an end portion extending through the passage.

14. The reel system of claim 13, wherein the end portion extends through the passage along the second axis such that the reel and the frame are rotatable about the end portion.

15. The reel system of claim 1, wherein the bearing assembly defines a passage extending therethrough, the supply line including an end portion extending through the passage along the second axis such that the reel and the frame are rotatable about the end portion.

16. The reel system of claim 1, wherein the frame is mounted directly above the base.

* * * * *